US009458582B2

(12) United States Patent
Poirier et al.

(10) Patent No.: US 9,458,582 B2
(45) Date of Patent: Oct. 4, 2016

(54) FERRY BRIDGE

(75) Inventors: Paul Poirier, Nantes (FR); Timothée Paulin, Nantes (FR); Xavier De Champs, Nantes (FR)

(73) Assignees: SOLETANCHE FREYSSINET, Rueil Malmaison (FR); NANTAISE DES PONTS ET PYLONES INTERNATIONAL, Nantes (FR)

( * ) Notice: Subject to any disclaimer, the term of this patent is extended or adjusted under 35 U.S.C. 154(b) by 729 days.

(21) Appl. No.: 13/806,653

(22) PCT Filed: Jun. 22, 2011

(86) PCT No.: PCT/FR2011/051437

§ 371 (c)(1),
(2), (4) Date: Jun. 14, 2013

(87) PCT Pub. No.: WO2011/161379

PCT Pub. Date: Dec. 29, 2011

(65) Prior Publication Data

US 2015/0315752 A1 Nov. 5, 2015

(30) Foreign Application Priority Data

Jun. 22, 2010 (FR) ..... 10 54950

(51) Int. Cl.

| | |
|---|---|
| ***E01D 11/02*** | (2006.01) |
| ***E01D 15/00*** | (2006.01) |
| ***E01D 15/10*** | (2006.01) |

(52) U.S. Cl.

CPC ..... *E01D 11/02* (2013.01); *E01D 15/005* (2013.01); *E01D 15/10* (2013.01)

(58) Field of Classification Search

CPC ..... E01D 11/02; E01D 15/005; E01D 15/10
USPC ..... 14/2.4, 3, 4, 5, 8, 18–21; 114/70
See application file for complete search history.

(56) References Cited

U.S. PATENT DOCUMENTS 3,320,918 A * 5/1967 Zalejski ..... 114/70

FOREIGN PATENT DOCUMENTS

FR 2949495 * 8/2009 ..... E04H 12/00

OTHER PUBLICATIONS

Unknown: "Pont transbordeur", Wikipedia, Aug. 22, 2011, XP002622002, Attached copy retrieved on Feb. 15, 2013 from the internet: URL:http://fr.wikipedia.org/wiki/pont_transbordeur.

*Primary Examiner* — Raymond W Addie
(74) *Attorney, Agent, or Firm* — Dentons US LLP

(57) ABSTRACT

A ferry bridge having two sets of posts anchored on either side of a thoroughfare, support at height a deck over which a carriage moves, wherein a pod is suspended from said carriage for providing the transport of vehicles and passengers between two ferry docks on either side of said thoroughfare, the platform of said pod being divided into a central area dedicated to the transport of vehicles and two side areas dedicated to the transport of passengers. the entrances to the passenger transport areas are arranged on the outer lateral sides of the pod relative to the axis of movement (A) of the pod. The entrances to the vehicle transport area are arranged on the sides opposite said lateral sides, and the ferry docks for the pod comprise a means for separating the vehicles and the passengers into two streams directed toward the specific entrances thereof, respectively.

9 Claims, 1 Drawing Sheet

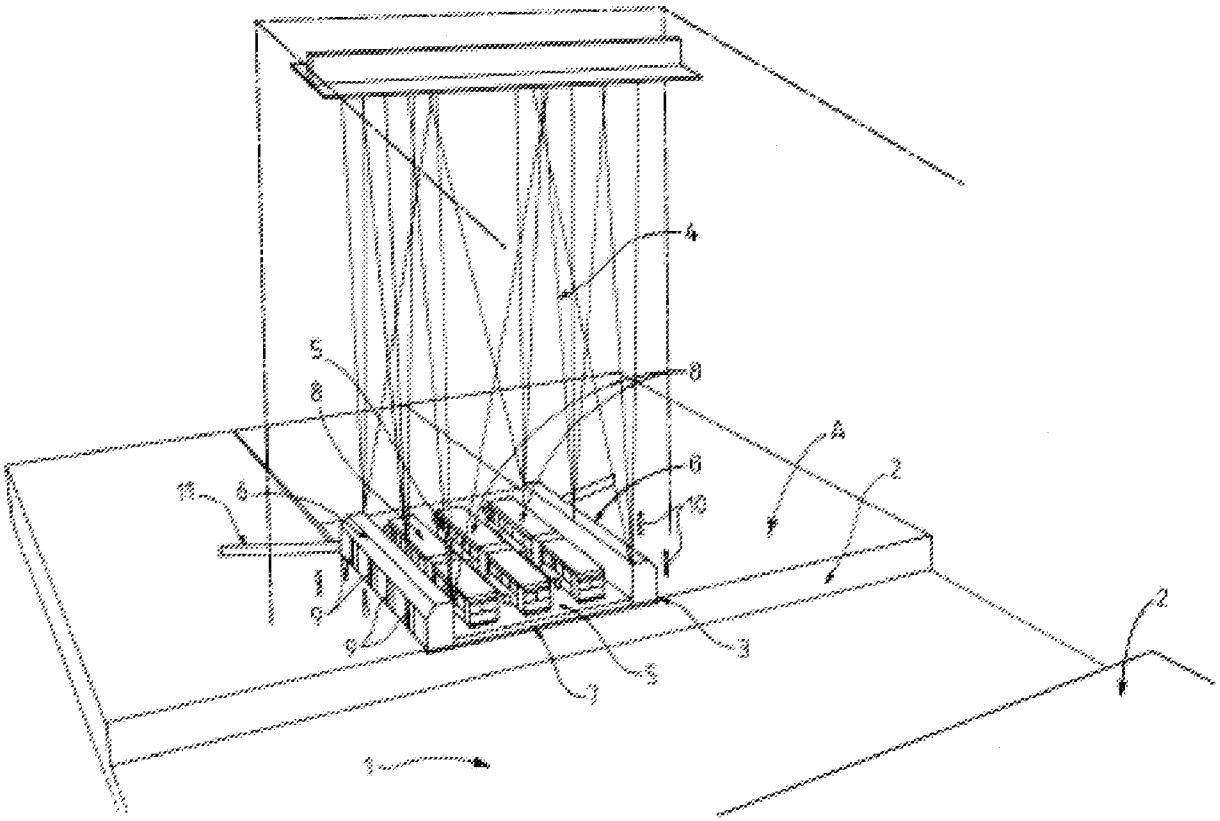
1
2
3
4
5
6
7
8
9
10
11
12
13
14
15
16
17
18
19
20
21
22

FERRY BRIDGE

This Application is a 35 U.S.C. §371 National Stage Entry of International Application No. PCT/FR2011/051437, filed Jun. 22, 2011, and claims the benefit of French Application No: 1054950, filed Jun. 22, 2010, all of which are incorporated by reference in their entirety herein.

The invention relates to the arrangement of gondolas and quays of ferry bridges.

BACKGROUND OF THE INVENTION

Ferry bridges have been known since the end of the nineteenth century as a means for rapidly conveying vehicles and pedestrians from one bank of a river to the other. They are hanging bridges, the deck of which is placed at height on two towers erected on either side of a river. Under the deck, there moves a carriage from which the gondola is suspended by cables triangulated to avoid any swaying phenomena.

Ferry bridges have the advantage of allowing free passage for maritime traffic and, compared with maritime ferries, of being independent of tidal phenomena, more rapid, more comfortable and safer.

However, notwithstanding these advantages, the technology of ferry bridges virtually stopped being used from the middle of the last century, principally on account of its inability to respond to the speeds imposed by the increase in traffic.

The inventors have identified one of the essential reasons for this limitation in terms of flow, namely the fact that in the gondolas of known ferry bridges, the streams of vehicles and passengers are mixed during embarkation and disembarkation.

An object of the invention is to remedy this drawback.

SUMMARY OF THE INVENTION

It relates to a ferry bridge of the type in which two tower sets anchored on either side of a thoroughfare, such as a river, support at height a deck under which there moves a carriage from which there is suspended a gondola for simultaneously transporting vehicles and passengers between two quays on either side of said thoroughfare, the platform of said gondola being divided into a central zone for transporting vehicles and two lateral zones for transporting passengers, characterized in that the zones for transporting passengers have access points located on the outer lateral sides of the gondola with respect to the movement axis of the gondola, the zone for transporting vehicles has access points located on the opposite sides from said lateral sides, and in that the quays of the gondola comprise means for separating the vehicles and passengers into two streams respectively directed towards their specific access points.

As a result of this combination of measures, not only is the movement of vehicles during embarkation and disembarkation phases geographically completely separate from—and thus not hampered by—the presence of passengers, but also the zone for the access of passengers is very greatly increased in size since it can extend along the entire length of the gondola, whereas in the known gondolas it is limited to a portion of the width of the platform, generally the entrance to the roadway intended for vehicles. This constitutes a very large accelerating factor in the speed of embarkation and disembarkation of the passengers in complete safety.

BRIEF DESCRIPTION OF THE DRAWINGS

Further features and advantages of the invention will become apparent from the following description of an exemplary embodiment with reference to the appended drawing, which schematically shows a ferry bridge gondola and its quay, arranged in accordance with the invention.

DESCRIPTION OF EMBODIMENTS

In the single FIGURE, the references respectively denote the following: 1, the thoroughfare, for example a river, over which the ferry bridge is located; 2, one of the banks of the river 1; 3, the gondola; 4, the cables connecting the gondola 3 to the carriage carried by the deck of the bridge; 5, the central zone of the platform of the gondola 3; 6, the lateral zones of said platform; 7, the quay of the gondola 3. In order not to overburden the description, the other elements of the ferry bridge (towers, deck, carriage, etc.), which are well known to a person skilled in the art, have not been shown. Similarly, the quay has only been shown from one side of the thoroughfare served by the ferry bridge, the arrangement of the quay being identical on each bank.

It can be seen that the platform of the gondola 3 comprises a central zone 5, the access points to which are located along the longitudinal movement axis A of the gondola and which is used for vehicles 8. This central zone is bordered by two lateral zones 6, realized as reception cabins for the passengers 10, said cabins extending along the entire length of the platform, being closed on the side of the central zone 5 and having their ends arranged along the axis A, and being provided with access doors 9 located on their respective outer lateral faces.

Arranged on the quay 7, in line with each of the two cabins 6, are means 11 for guiding the movement of the passengers 10 on the quay, such as markings on the ground or barriers, so as to separate the stream of passengers from the stream of vehicles 8.

Alternatively, the interior and also the exterior of the cabins can likewise be set up such that only some of the access doors are used for the boarding of the passengers, the others being used for their alighting. This makes it possible to continuously coordinate the stream of passengers boarding the cabin with the stream of passengers alighting therefrom.

In the example shown, it can be seen that the quay 7 has an excavation intended to receive the bottom part of the gondola such that the floor of its platform is located at the level of the roadway of the quay.

Alternatively, the quay can be designed without an excavation, the gondola arriving above the level of the quay. In this case, the quay is equipped with access ramps both for the vehicles and for the passengers.

Although the invention has been described in connection with one particular embodiment, it is quite clear that it is in no way limited thereto and that it includes any technical equivalents of the means described, and any combinations thereof, where these are within the scope of the invention.

What is claimed is:

1. A ferry bridge comprising:

two tower sets anchored on either side of a thoroughfare;

a deck supported at height by the towers;

a carriage movable under the deck;

two quays, one on each side of the thoroughfare; and a gondola suspended from the carriage for transporting vehicles and passengers along a movement axis between the two quays, the gondola having a platform divided into a central zone for transporting vehicles and two lateral zones for transporting passengers, wherein each quay is shaped so as to be located on at least two sides of a gondola, when present, wherein the two lateral zones have first access points located on outer lateral sides of the gondola with respect to the movement axis, wherein the central zone has second access points located on the opposite sides from said lateral sides, and wherein each quay comprises two zones, a vehicle zone and a passenger zone, arranged for separating the vehicles and passengers into two streams directed towards the second and first access points, respectively.

2. The ferry bridge of claim 1, wherein the two lateral zones comprise cabins extending along the entire length of the platform, and wherein the cabins are provided with access doors located on respective outer lateral faces thereof.

3. The ferry bridge of claim 2, wherein the cabins have an interior set up such that only some access doors are used for boarding passengers, the other access door being used for alighting passengers.

4. The ferry bridge of claim 2, wherein the cabins have an exterior set up such that only some access doors are used for boarding passengers, the other access door being used for alighting passengers.

5. The ferry bridge of claim 1, wherein the quays have guides for the passengers, located in line with each of the two lateral zones.

6. The ferry bridge of claim 1, wherein the quays of the gondola comprise an excavation intended to receive the bottom part of the gondola.

7. The ferry bridge of claim 1, wherein the thoroughfare is a river.

8. The ferry bridge of claim 5, wherein the guides comprise markings on the ground.

9. The ferry bridge of claim 5, wherein the guides comprise physical barriers.

* * * * *